US005797608A

United States Patent [19]

Haldemann

[11] Patent Number: 5,797,608

[45] Date of Patent: Aug. 25, 1998

[54] IN-LINE ROLLER SKATE WITH RELEASABLE BOOT

[75] Inventor: Gaston Haldemann, Burgenstock, Switzerland

[73] Assignee: Skis Rossignol S.A., France

[21] Appl. No.: 927,835

[22] Filed: Sep. 11, 1997

[30] Foreign Application Priority Data

Sep. 12, 1996 [FR] France ..... 96 11345

[51] Int. Cl.[6] ..... A63C 17/04

[52] U.S. Cl. ..... 280/11.3; 280/11.22; 280/11.27

[58] Field of Search ..... 280/11.22, 11.27, 280/11.23, 11.28, 11.19, 87.041, 87.042, 11.3, 11.31, 11.32, 11.33, 613

[56] References Cited

U.S. PATENT DOCUMENTS 2,244,719 6/1941 Mansfield ..... 280/11.3
5,052,710 10/1991 Provence et al. .
5,123,664 6/1992 DeMars .
5,193,827 3/1993 Olson .
5,507,506 4/1996 Shadroui .
5,662,338 9/1997 Steinhauser, Jr. ..... 280/11.3

FOREIGN PATENT DOCUMENTS 0031570 7/1981 European Pat. Off. .
3432065 8/1985 Germany .

*Primary Examiner*—Richard M. Camby
*Attorney, Agent, or Firm*—Kane, Dalsimer, Sullivan, Kurucz, Levy and Eisele and Richard, LLP

[57] ABSTRACT

An in-line roller skate having a boot fixed releasably to a chassis. The fastening device uses the toggle effect and comprises a latch which is articulated to the chassis and has a point which interacts with a housing on the boot. This latch is kept engaged by the blocking of a toggle joint which can be actuated by means of a lateral lever. The boot is fixed at an opposite position (A) by a hook.

The latch may be in the form of a pedal actuable by the boot.

15 Claims, 10 Drawing Sheets

IN-LINE ROLLER SKATE WITH RELEASABLE BOOT

FIELD OF THE INVENTION

The present invention relates to a roller skate comprising a chassis equipped with rollers and a boot fixed releasably to this chassis by fastening means which secure the boot to the chassis, at a first location by attachment effected by the mutual longitudinal engagement of a part of the boot and a part of the chassis, and at a second location by a toggle-effect fastening device.

The invention relates in particular, but not exclusively, to an in-line roller skate.

PRIOR ART

Devices for releasably fixing a skate to a boot have long been known, in particular for fastening ice skates to boots which were also used for walking or for engaging in other sports. Swiss Patent CH 118 742 represents a roller skate and an ice skate which, at the rear, comprise a hook engaging in the front face of the heel and, at the front, a clip which is actuated by a lever and laterally clips the boot on its sides. The skate described in U.S. No. Pat. 1,402,010 is also equipped with a clip device which can be actuated by a lever.

In a more modern version, described in U.S. No. Pat. 3,918,729, the sole of the boot is fitted with a metal plate which, at the front, has two keyhole-shaped holes which hook on to two studs on the skate and, at the rear, a bayonet hole in which a rotary skate-fasexpress tening member engages for bayonet-fastening of the boot.

In U.S. No. Pat. 5,507,506, the skate has, at the front, a first slide rail for the boot and, at the rear, a second slide rail and a sprung latch which longitudinally locks the boot on the skate. The fastening device does not therefore have a rotary member, but the boot needs to be engaged precisely in the slideways, in order for the fastening not to have any play.

With the aim of producing a fastening device which has a particularly simple structure and is easy to operate, in order to make it possible to mount the same boot on roller skates or ice skates, patent FR 2,720,286 proposes fastening by hooking at the front and, at the rear, by a system of levers which are mounted on the back of the boot and hold the boot to the skate by toggle effect. This fastening device requires at least two operations, namely hooking the toggle joint to the skate and closing this toggle joint, and a third movement if it is desired to disengage the boot from its fastening device. The toggle joint further forms a projection at the rear of the boot.

SUMMARY OF THE INVENTION

The object of the present invention is to produce a reliable and convenient quick-fastening device of minimal size.

The roller skate according to the invention is one wherein the toggle-effect fastening device is located under the boot and comprises a latch which is articulated to the chassis about a transverse pin and has a pointed end that interacts with a housing on the boot, this latch being capable of occupying two stable positions, namely an obliquely raised position in which its point is out of the housing on the boot, and a lowered position in which its point is engaged in the housing on the boot, in the opposite direction to the engagement at the first hooking location, and kept engaged by the blocking of the toggle joint by exerting, on the one hand, a vertical pressure and, on the other hand, a longitudinal thrust in the opposite direction.

The moving parts of the fastening device are therefore entirely located on the skate.

The hooking by the fixed means will preferably take place at the front of the boot, but it could also take place at the rear, that is to say in the heel region.

The latch has the advantage of exerting on the boot both a downward pressure which presses it onto the skate, and a longitudinal thrust in the opposite direction to the engagement of the fixed hooking members, which makes it possible, by wedge and ramp effect, to eliminate any play in the fastening.

According to particularly advantageous embodiments of the invention, the latch is in the form of a pedal which is lowered, for locking, by a pressure exerted on the boot. This allows the fastening to be automatic.

The pedal may be articulated to the end of a pair of toggle-effect levers, or itself constitute one of the two elements of the toggle joint. In the first case, the toggle joint is locked by means of an auxiliary lever, using which the central articulation of the toggle joint is moved beyond its unstable equilibrium position. In the second case, the first part of the toggle joint is elastically compressible axially, which allows the central pin of the toggle joint to move to the other side of its unstable equilibrium position simply by pressing on the pedal. Using a fairly strong spring and a suitable ratio of moments allows the boot to be quasi-locked in the position where it is fixed to the skate. It is, however, preferable to provide auxiliary locking means, in particular a latch which locks an auxiliary point of the pedal, or a latch which engages under the central articulation of the toggle joint.

In the case of a latch which locks an auxiliary point of the pedal, this latch may be held in the locked position by a spring, and the auxiliary point of the pedal may have a ramp allowing it to push the latch away when the pedal descends, which allows automatic locking to be obtained. It is then sufficient to connect the latch to a manual retraction means to allow the boot to be taken off the skate.

BRIEF DESCRIPTION OF THE DRAWINGS

Other features and advantages of the invention will emerge during the following description of illustrative embodiments of in-line roller skates, which is given with reference to the appended drawing, in which.

DESCRIPTION OF THE PREFERRED EMBODIMENTS

Figure 1:
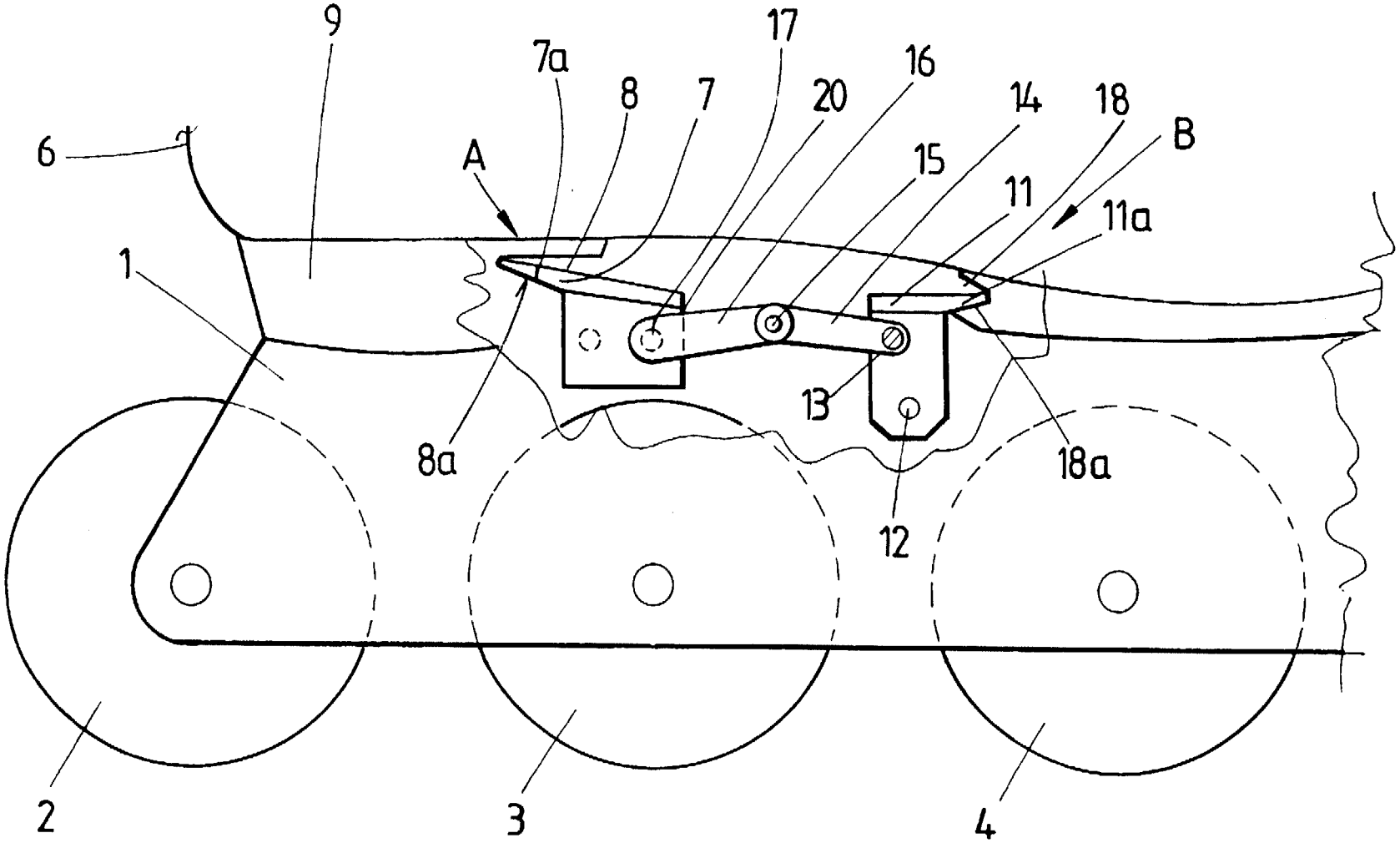
FIG. 1 is a partial schematic side view of a first embodiment.
Figure 2:
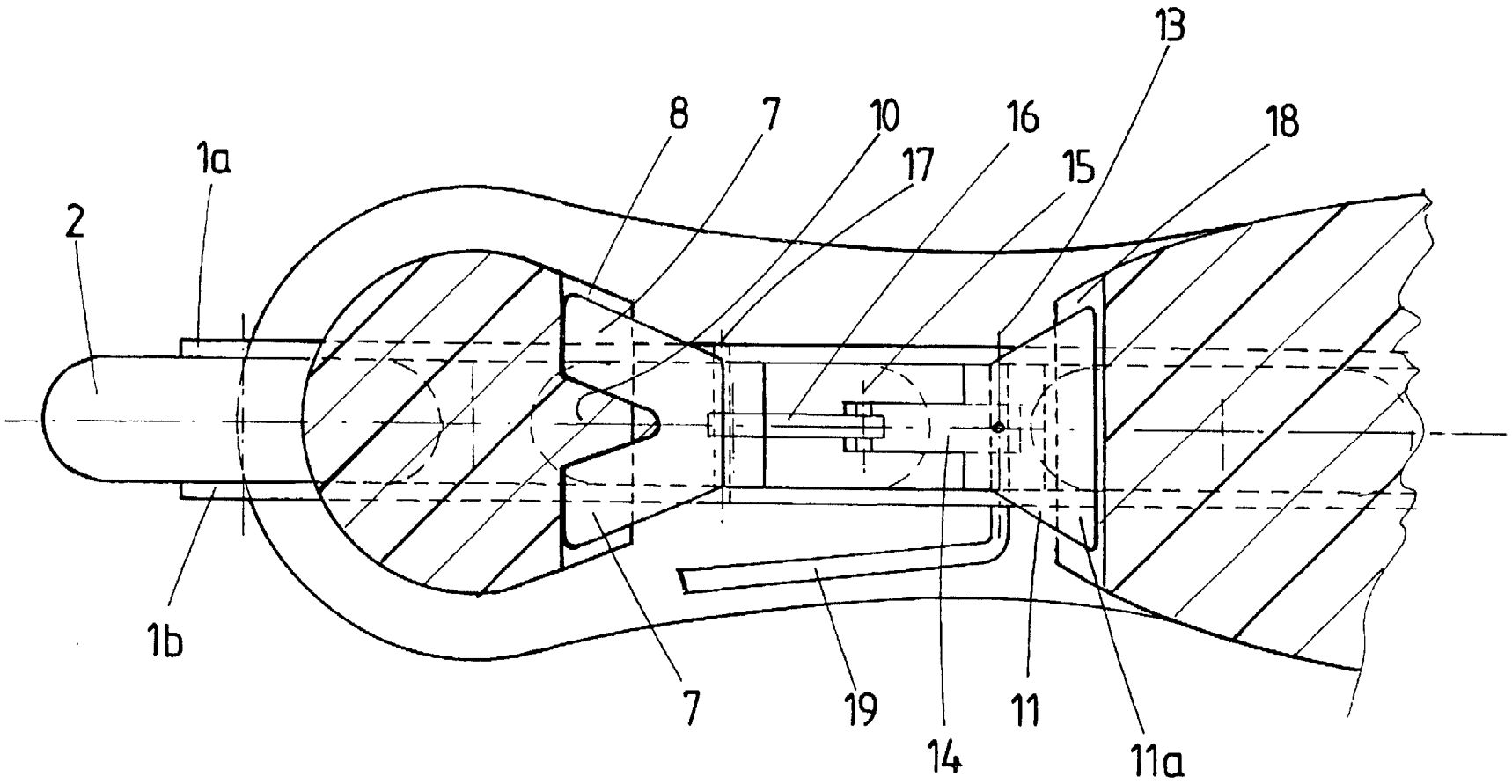
FIG. 2 is a plan view of this first embodiment.

The skate represented in FIGS. 1 and 2 comprises a chassis 1 having two parallel vertical flanks 1*a* and 1*b*, between which four rollers are mounted, three of which can be seen in the drawing, specifically rollers 2, 3 and 4. A boot 6 fastens releasably to this chassis 1 at two locations A and B. In this first embodiment, A is located in the rear region of the skate and B in the front region.

Fastening at location A is carried out by means of a lug 7 which is fixed to the chassis 1 and is directed forward, and a wedge-shaped housing 8, also directed forward, formed in a part 9 of the boot which may at the same time constitute the sole of this boot. As can be seen in the plan view, the lug 7 is divided into two by a V-shaped slot, into which a correspondingly shaped central wall 10 of the boot engages. The housing 8 is therefore itself divided into two parts by the wall 10, which constitutes a centering member for the lug 7. On its lower face, the lug 7 has an oblique ramp 7*a* which bears on a corresponding oblique ramp 8*a* of the housing 8.

At location B, fastening is provided by a latch 11 provided with a wedge-shaped point 11*a*. This latch 11 is articulated, on the one hand, to the chassis about a transverse pin 12 and, on the other hand, about a pin 13 at the end of a first arm 14 articulated about a pin 15 at the end of a second arm 16, the other end of which is articulated to the chassis about a pin 17. The arms 14 and 16 constitute a toggle joint. The boot has a housing 18, also in the shape of a wedge, in which the point 11*a* of the pedal 11 engages. The arm 14 is also secured, via its end articulated about the pin 13, to a lever 19 extending on the side of, and externally to the chassis 1. In the position represented in FIG. 1, the points 7*a* and 11*a* are engaged in the boot, and the articulation 15 of the toggle joint is located above the line joining the pins 13 and 17. The point 11*a* of the latch 11 is fully engaged in the housing 18 on the boot, with some degree of tension because the arm 16 of the toggle joint abuts against the front edge 20 of the hook 7. Any lifting of the boot relative to the chassis 1 is therefore impossible. The rearward thrust exerted by the latch 11 has the effect of pressing the point 7*a* into the housing 8.

In order to disengage the boot, it is sufficient to lower the lever 19, which has the effect of moving the articulation 15 of the latch to below the line joining the pins 13 and 17. The boot can then be lifted by the rear and released from the latch 11, which is raised during this movement. In this position, the skate is also ready to receive the boot in order to fasten it. To this end, the boot is firstly engaged on the point 7*a*, with the front part of the boot resting on the chassis. In order to lock the fastening, it is sufficient to raise the arm 19, which has the effect of engaging the latch 11 in the housing 18 on the boot and to bring the toggle joint into the position which is represented. It is, of course, possible to reverse the fastening locations A and B.

In the embodiment which has just been described, the latch 11 is engaged manually in the housing on the boot by using a lever. It is, however, possible to use the boot to perform this engagement, and thus to obtain automatic engagement. The following figures represent embodiments of this type.

Figure 3:
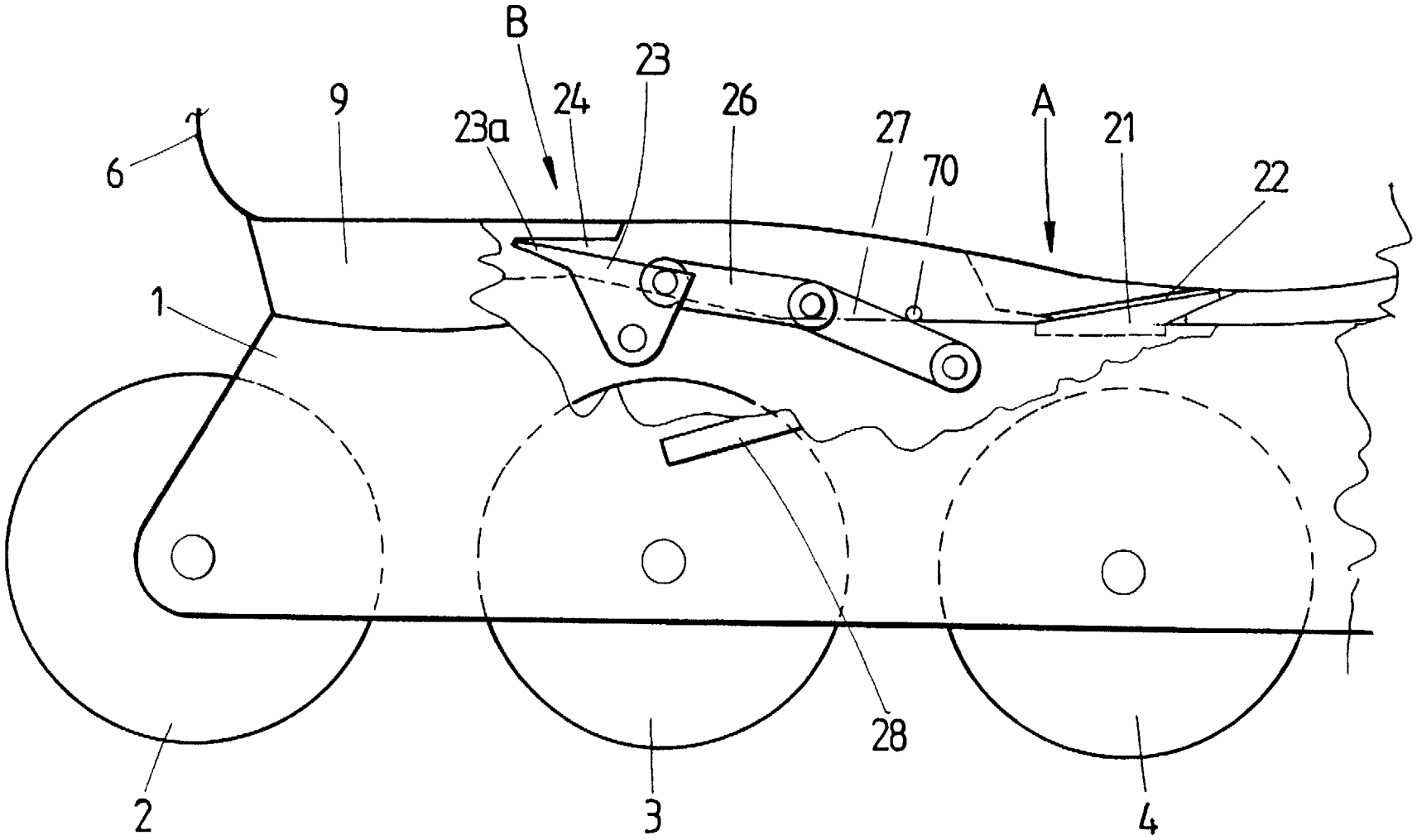
FIG. 3 is a partial side view of a second embodiment.
Figure 4:
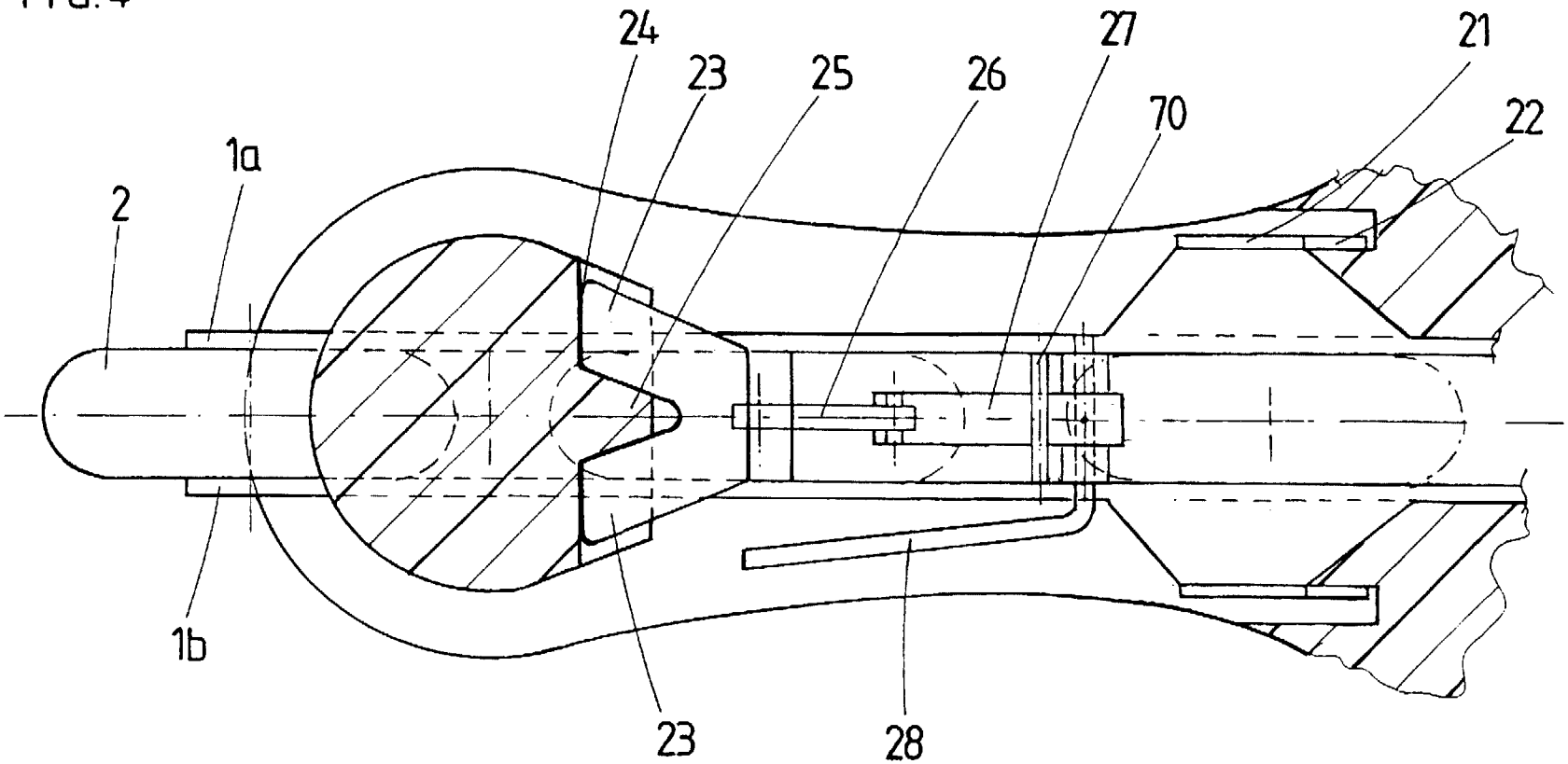
FIG. 4 is a plan view of this second embodiment.

In the embodiment represented in FIGS. 3 and 4, the locations A and B are reversed relative to FIG. 1. At the front, the chassis 1 is provided with a wedge-shaped hook 21 which engages in a housing 22 on the boot. At the rear, a pedal-shaped latch 23, divided into two branches separated by a V-shaped notch, engages in a housing 24 on the boot, this housing itself being divided into two by a V-profile central wall 25 and engaging between the arms of the pedal 23 in order to center the latter. The pedal 23 is articulated to the end of a toggle joint 26/27 similar to the previous toggle joint. When the boot is engaged, the raised pedal 23 is lowered by the upper wall of the housing 24 and engages automatically in the housing 24. A lever 28 allows the toggle joint 26/27 to be locked an unlocked. The point 21 itself consists of a pair of points which each interact with the housing 22, also providing centering at the front.

In the following embodiments, the pedal itself constitutes one of the arms of the toggle joint.

Figure 6:
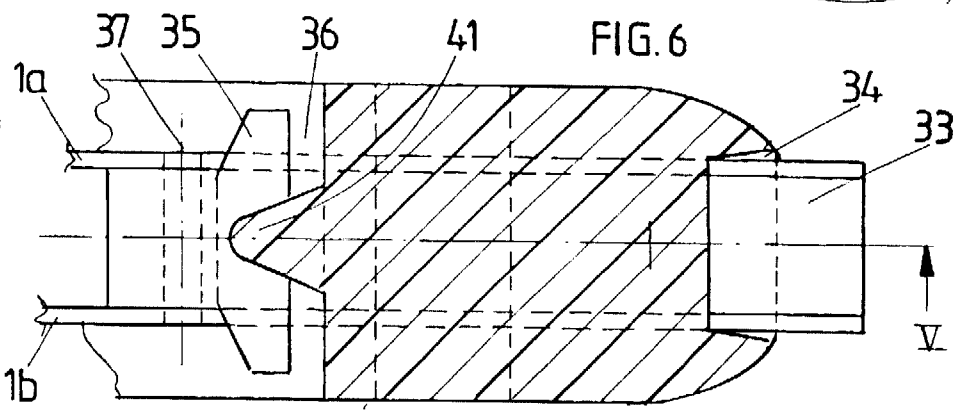
FIG. 6 is a plan view of the rear part of the fastening represented in FIG. 5.
Figure 7:
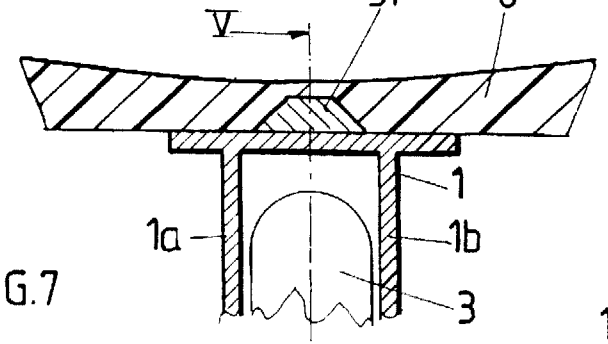
FIG. 7 is a partial view, in section on VII—VII in FIG. 5.

In the third embodiment, which is represented in FIGS. 5 to 7, there is again a chassis 1 having two parallel flanks la and 1*b*, between which four rollers 2, 3, 4, 5 are mounted. The two fastening locations A and B are both in the heel region 30 of the boot. The front region merely has a guide consisting of a trapezoidal longitudinal rib 31 of the chassis 1, which is engaged in a correspondingly profiled longitudinal groove 32 provided in the boot. Hooking at location A is provided by a wedge-shaped hook 33 which is secured to the chassis 1 and is engaged in a correspondingly shaped housing 34 on the heel of the boot. At location B, fastening is provided by a pedal 35, provided with a first point 35*a* which engages in a housing 36 on the boot, and via its lower face, bears against the lower wall 36*a* of the housing 36, and with a second point 35*b* which is located below the first point and forms an acute angle with this first point. The pedal 35 is articulated to the chassis 1 about a pin 37, and has an extension 35*c* beyond this pin, which extension constitutes one of the arms of a toggle joint, the other arm of which consists of a bar 38 sliding radially in a block 39 mounted so as to rotate in the chassis 1, and of a spring 40 which works in compression between a flat on the block 39 and the widened end 38*a* of the bar 38. This bar of the toggle joint is therefore axially compressible. At location A, centering is provided by the trapezoidal shape of the housing 34 on the boot. At location B, centering is provided in the same way as in the second embodiment, that is to say by a wedge-shaped central wall 41 of the housing 36, engaging in a correspondingly shaped notch in the pedal 35. Longitudinal positioning for engagement is provided by a semicylindrically shaped transverse boss 42 on the chassis, interacting with a correspondingly shaped groove provided in the boot.

Before the boot is engaged, the pedal 35 is raised, and the articulation 43 of the toggle joint is located to the right of its unstable equilibrium position and is held in the position 43' by a stop limiting the rotation of the pedal 35. When the boot presses on the pedal 35, the latter tilts, its point 35*a* slides over the sole in the direction of the housing 36, and at a given instant, the articulation 43 of the toggle joint passes its unstable equilibrium position and the spring 40 subsequently participates in the lowering of the pedal. Some degree of locking is thus already provided, the effectiveness of which increases if the spring 40 is strong and the ratio of the active and resisting moments is favorable. However, in order to provide proper locking, an actual latch 44 is provided, consisting of a rod which passes entirely through the chassis 1 via horizontal slots 45 and can, by simple pressure, be brought above the upper face of the second point 35*b* of the rocker. Unlocking is carried out by moving the latch 44 in the opposite direction. Using an auxiliary latch makes it possible to have a spring 40 of moderate force, making it possible to engage and disengage the boot with ease. In this embodiment, it is therefore firstly the heel which is engaged in the hook 33. Since longitudinal positioning is already provided by this engagement, the positioning 42 could be omitted. However, its presence has the effect of reinforcing the fastening in the longitudinal direction.

Figure 8:
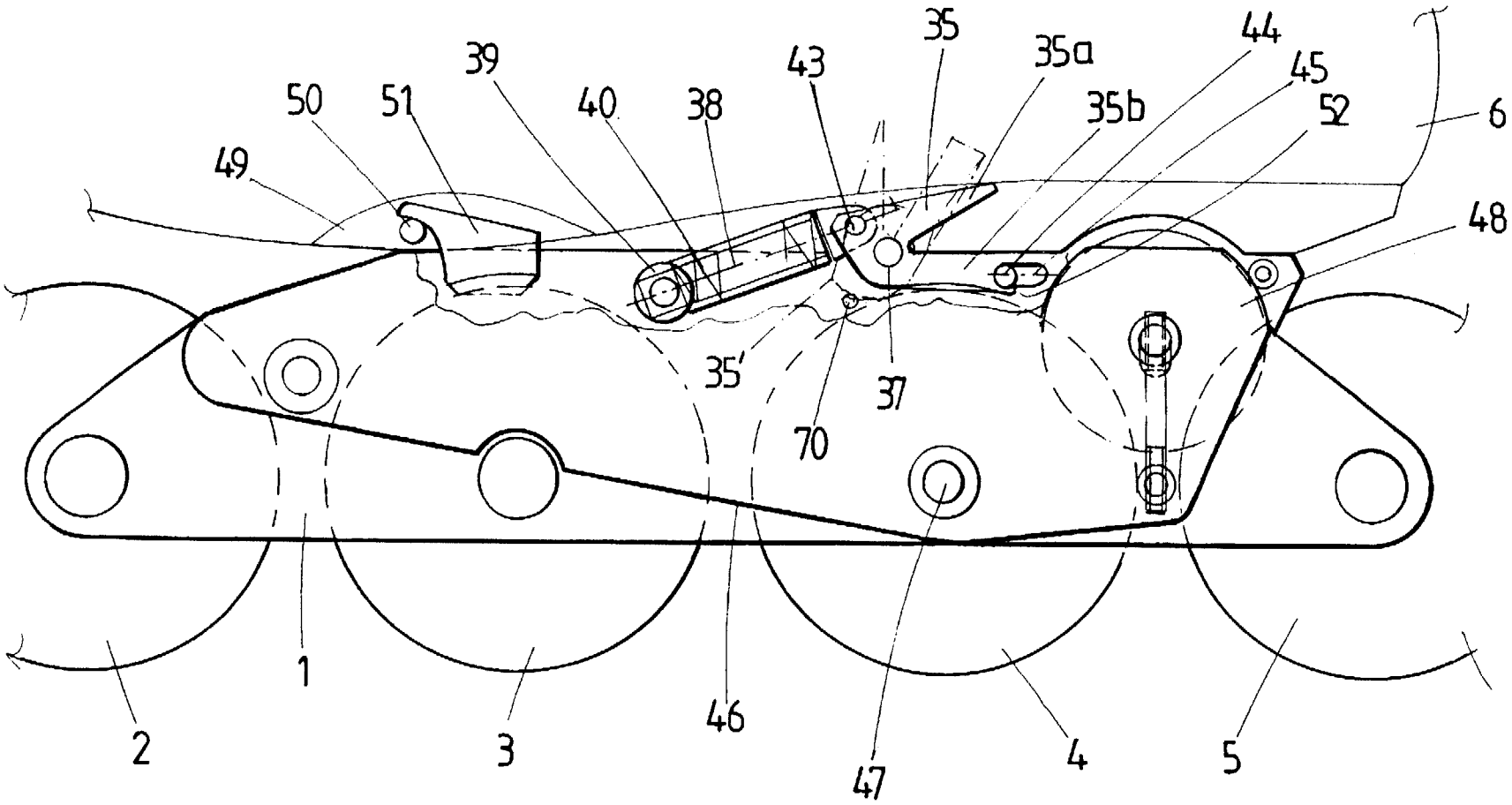
FIG. 8 is a side view of a fourth embodiment.

FIG. 8 illustrates the application of the fastening according to the invention to a skate having an auxiliary chassis and a disk brake. The skate comprises a main chassis 1, on which four rollers 2, 3, 4, 5 are mounted, and an auxiliary chassis 46 articulated to the main chassis about the axle 47 of the roller 4. This auxiliary chassis 46 is provided with a pair of brake disks 48 which are mounted so as to rotate and come into contact with the rollers 4 and 5 when the auxiliary chassis 46 tilts rearward about the axle 47, the disks 48 being pushed apart and exerting a braking effect by friction against the walls of the main chassis 1.

The boot 6 fastens to the auxiliary chassis 46. At the front, the boot has a hollow 49 through which a transverse rod 50 passes, this rod engaging under the oblique face of a hook 51 secured to the auxiliary chassis 46. In the rear region, the boot is fixed by a toggle device similar to the device represented in FIG. 5. For simplicity, the same references have been used, even though the pedal 37 has a slightly different shape. Locking is again provided by a transverse rod 44 sliding through slots 45 in the auxiliary chassis 46. Unlike in the third embodiment, the rod 44 locks the second point **35*b* of the pedal 35 by engaging in a groove 52** formed at the end of this point.

Figure 9:
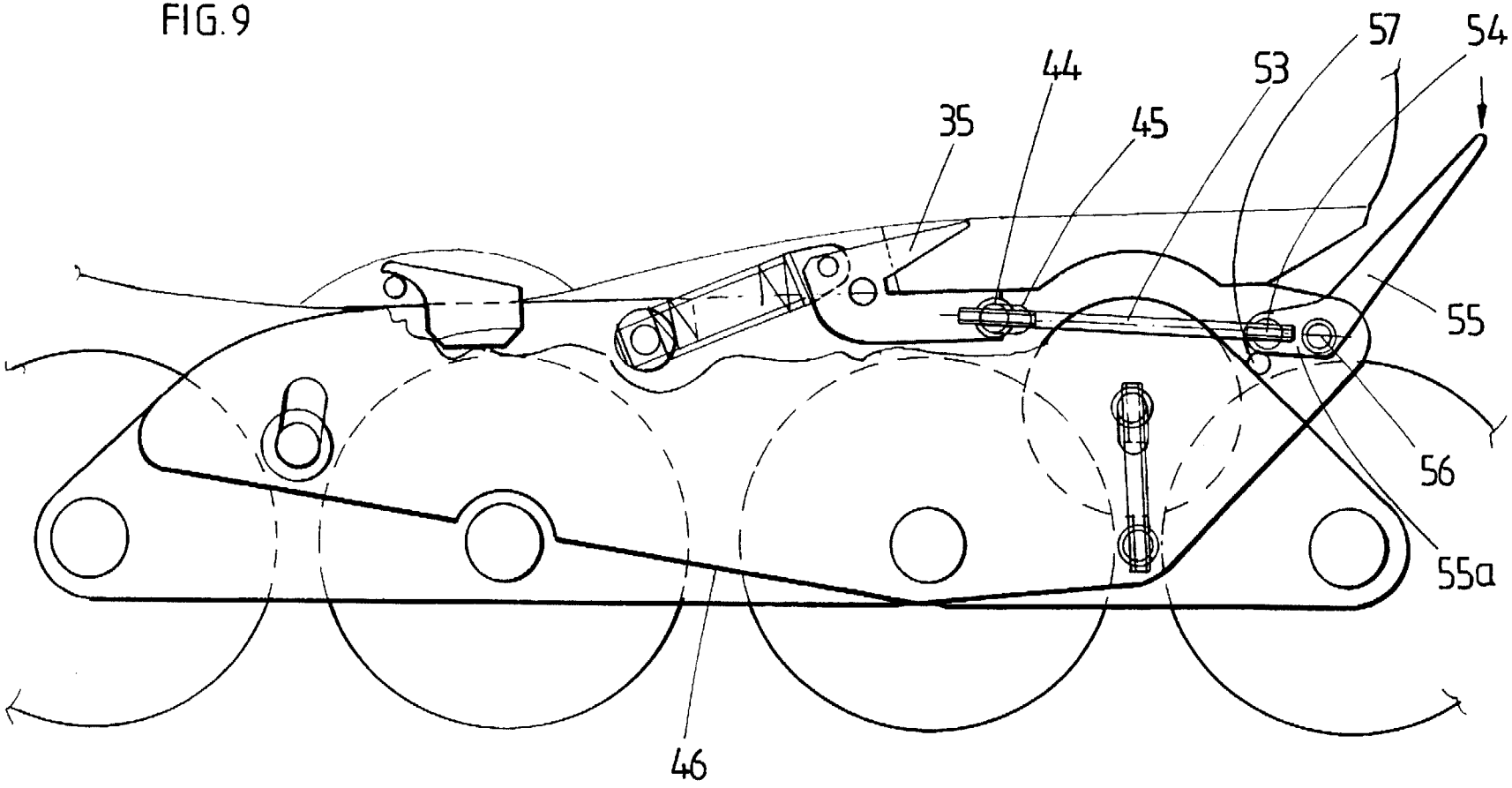
FIG. 9 is a side view of a fifth embodiment.

The fifth embodiment, which is represented in FIG. 9, is a variant of the fourth embodiment. In this variant, the locking rod 44 is mounted at the end of a bar 53 which is articulated about a pin 54 at the end of a first arm of a lever 55, in turn articulated about a pin 56 at the rear of the auxiliary chassis 46. The arm **55*a* of the lever 55 and the bar 53 also constitute a toggle joint. In the position which is represented, the toggle joint is blocked by the arm 55*a* abutting against a stop 57. The articulation 54 is slightly below its unstable equilibrium position. To unlock the pedal 35, it is sufficient to push the lever 55 back down by pressing on it as indicated by the arrow, which has the effect of pulling back the locking rod 44 which can move in the slots 45 which are here aligned with the articulation pin 56 of the lever 55**.

Figure 10:
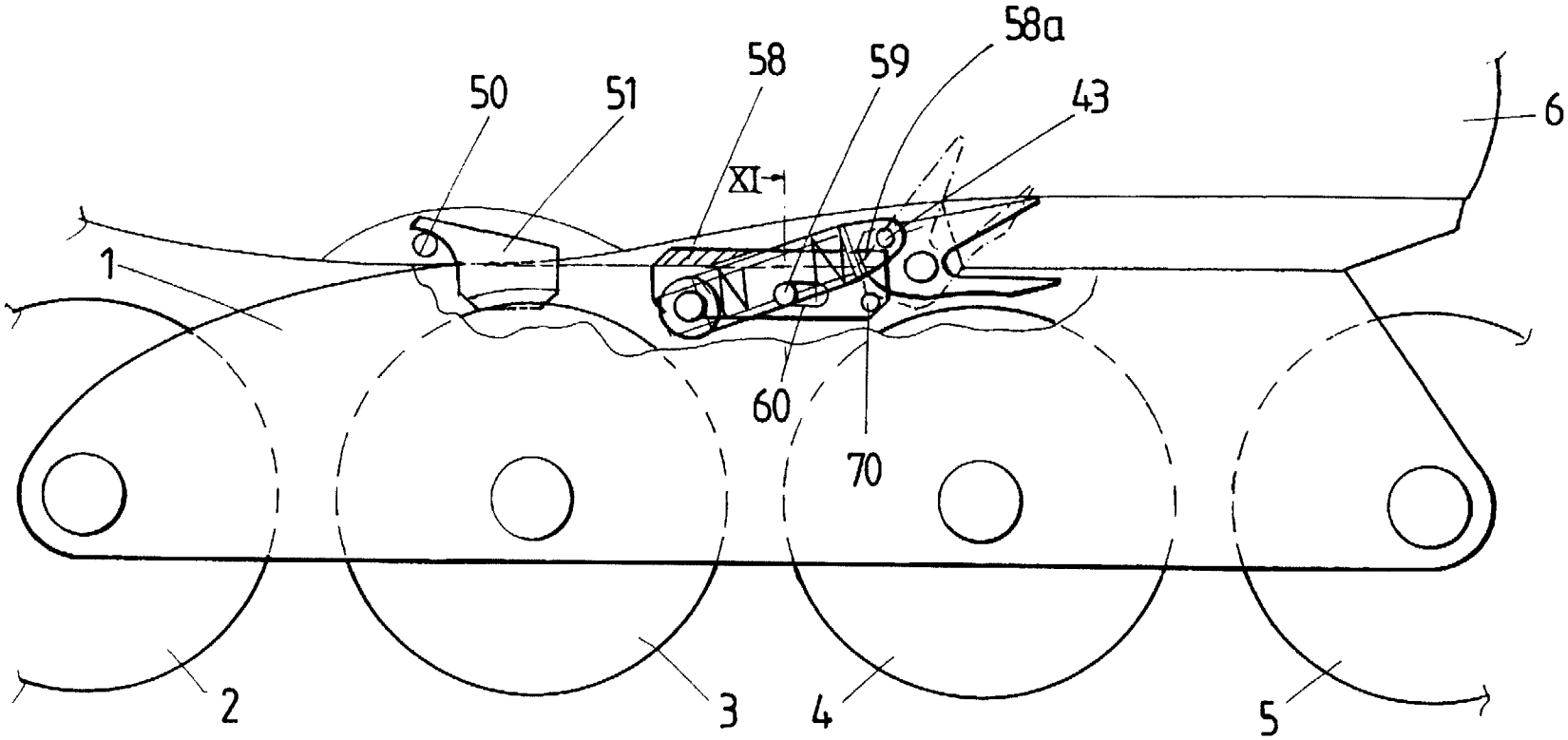
FIG. 10 is a side view of a sixth embodiment.
Figure 11:
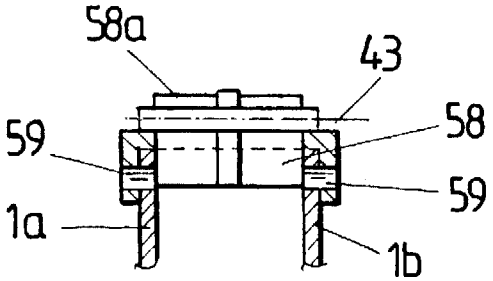
FIG. 11 is a partial view in section on XI—XI in FIG. 10.

The sixth embodiment, which is represented in Fig. 10, is an application of the fastening means represented in FIG. 8 to a skate which does not have an auxiliary chassis. The hook 51 and the toggle joint are therefore fixed and articulated, respectively, to the chassis 1. Locking is here provided by a slide 58 which has a U-shaped profile and slides over the chassis 1, while protruding on each side of the chassis. This slide 58 is guided by two studs 59 which are secured to the chassis 1 and are engaged in two longitudinal slots 60 provided in the sides of the slide 58. Locking is provided by the end **58*a* of the slide 58, this end being engaged under the articulation 43 of the toggle joint. For locking and unlocking, it is therefore sufficient to remove the slide 58**.

Figure 5:
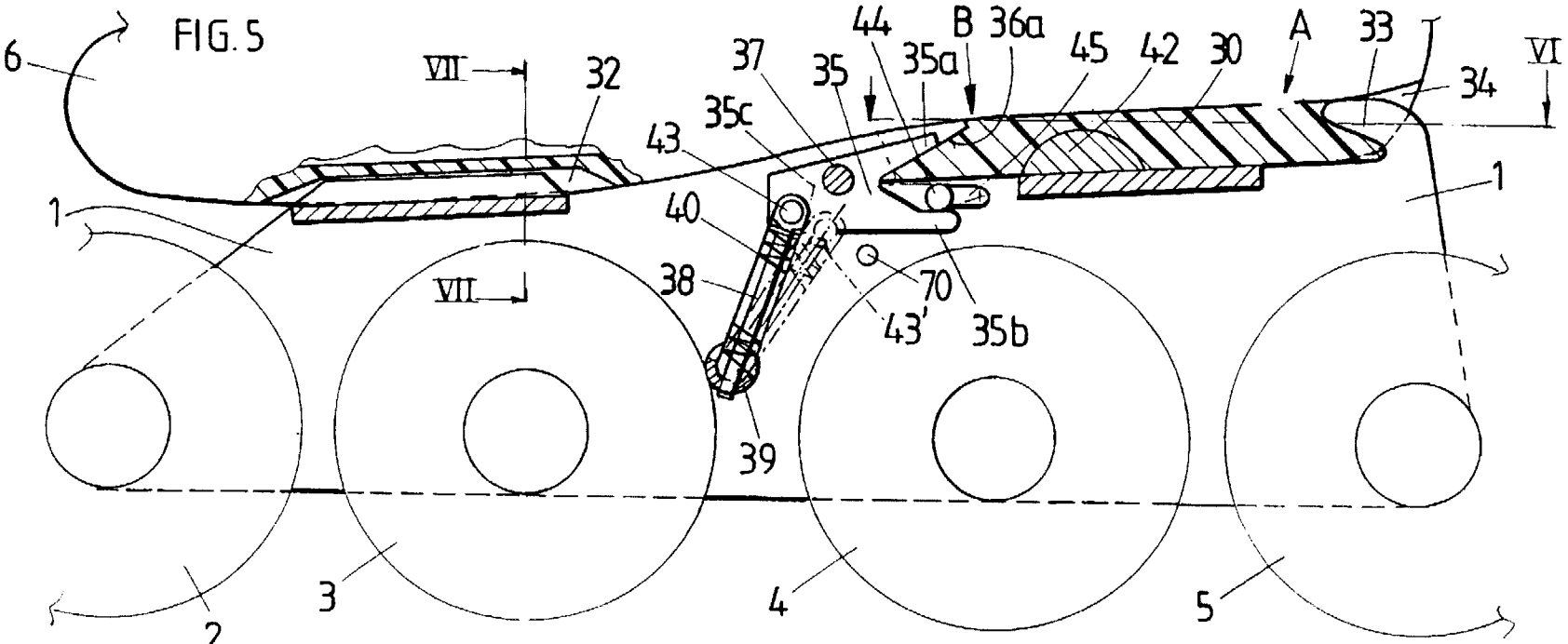
FIG. 5 is a side view, in section on V—V in FIG. 6, of a third embodiment.
Figure 12:
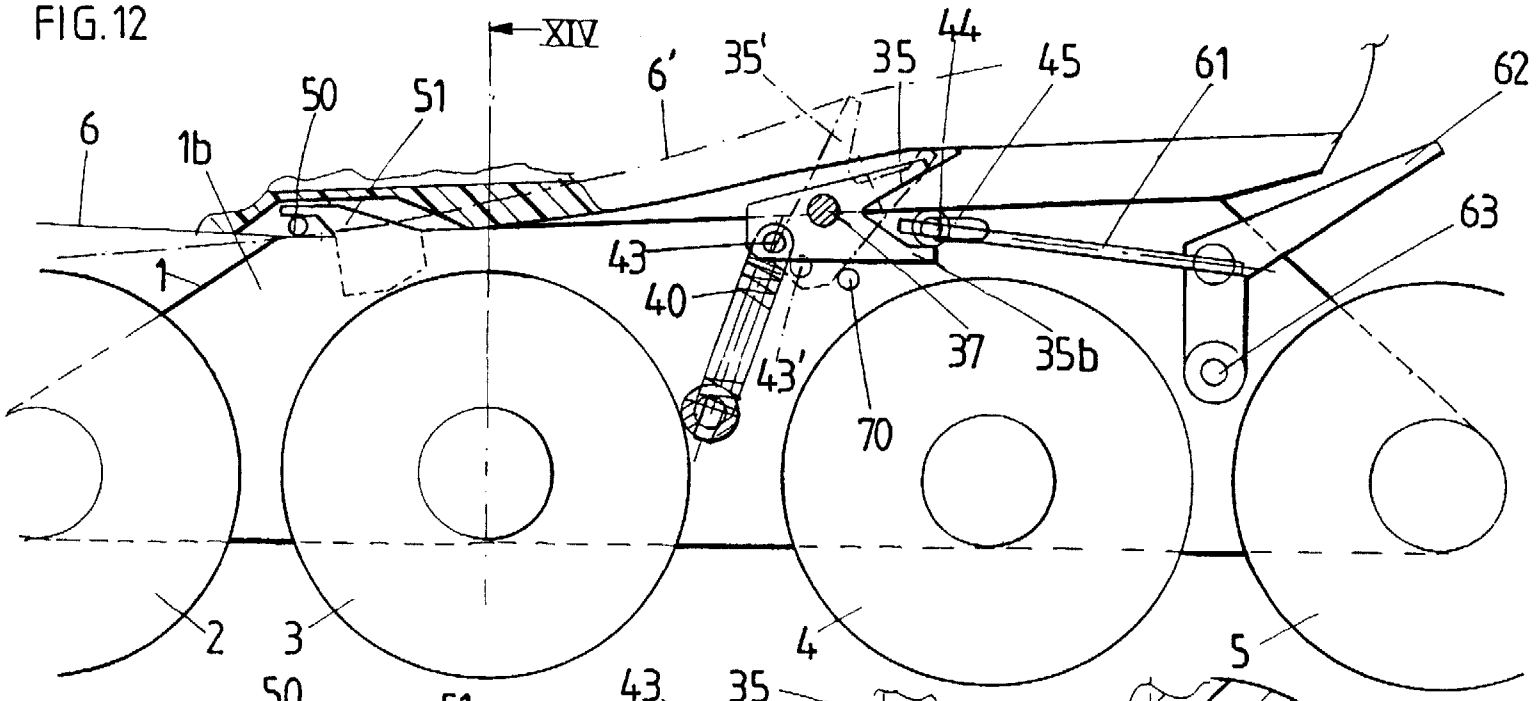
FIG. 12 is a side view of a seventh embodiment.
Figure 13:
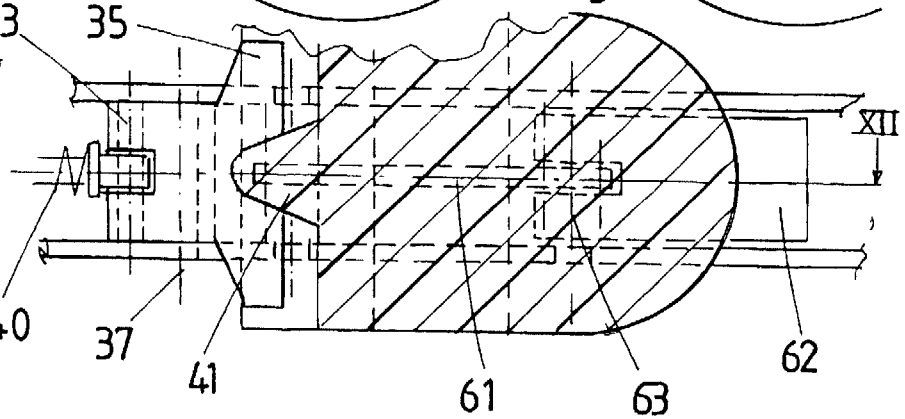
FIG. 13 is a plan view of the rear part of this seventh embodiment.
Figure 14:
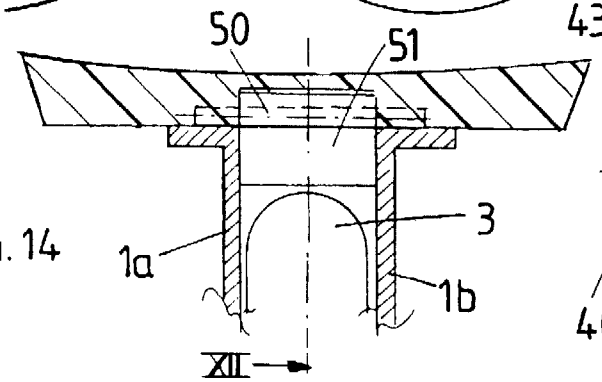
FIG. 14 is a partial view in section on XIV—XIV in FIG. 12.

The seventh embodiment, which is represented in FIGS. 12 to 14, uses the pedal in FIG. 5 and the front hooking in FIG. 4, in a slightly modified form. The locking rod 44 of the pedal 35 is fixed to the end of a bar 61, the other end of which is articulated to a second-class lever 62 articulated at 63 to the chassis 1. Locking and unlocking are carried out by actuation of the lever 62.

The pedal 35 is represented in the open position by dots and dashes 35'. In the open position, the lifting of the pedal 35 under the effect of the thrust of the spring 40 is limited by a stop 70. A stop of this type is, of course, also present in the embodiments according to FIGS. 5 to 11.

Figure 15:
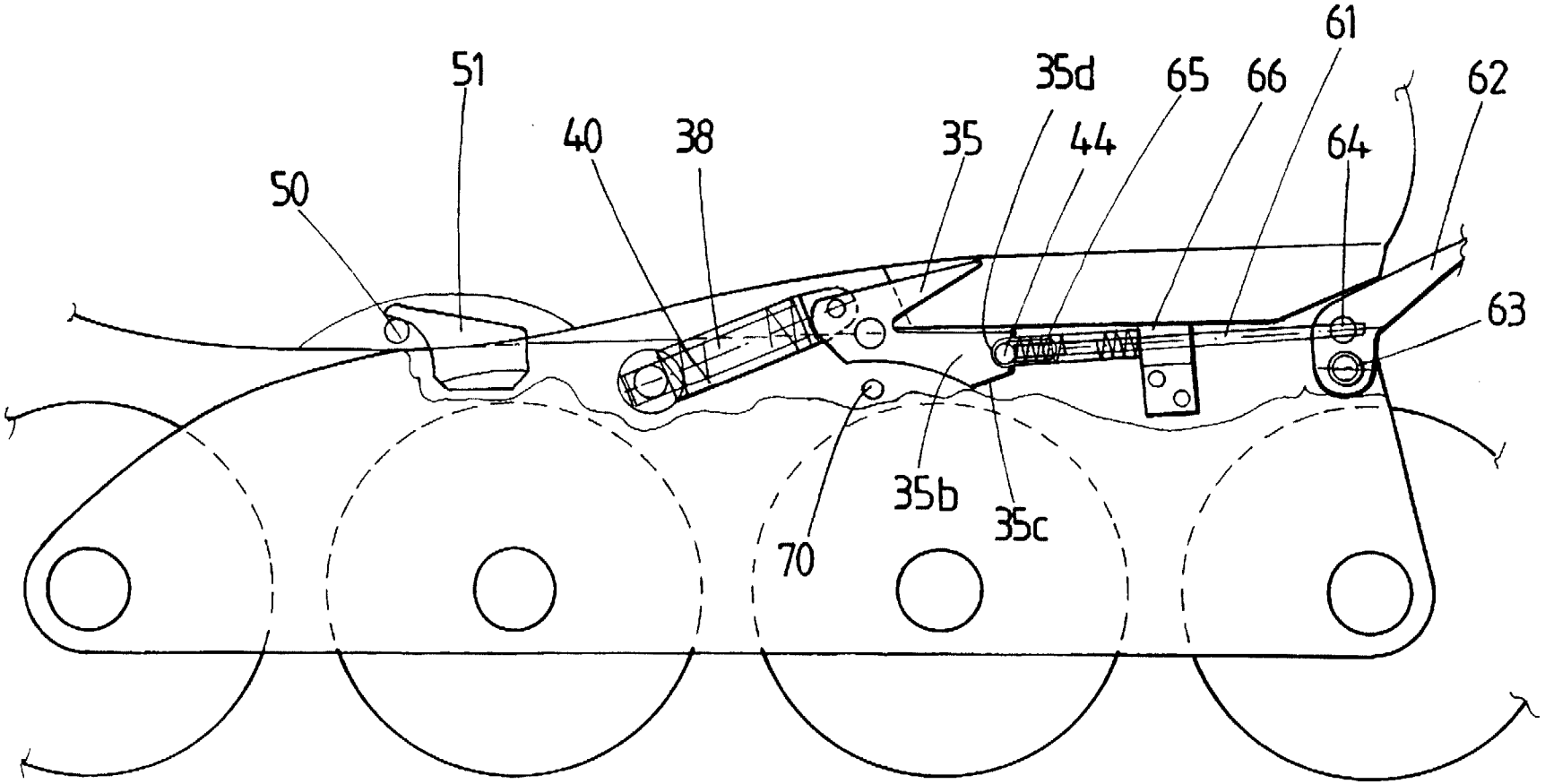
FIG. 15 represents an automatically locking version of the seventh embodiment.

By considering FIG. 12, it can be seen that automatic locking can be effected by designing the point **35*b* of the pedal 35 in such a way that it pushes away the latch 44 when the pedal 35 is lowered, by compressing a spring which tends to keep the latch 44 in the locking position. A variant of this type is represented in FIG. 15**.

The second point **35*b* of the pedal has a ramp 35*c* on its lower side. The bar 61 is held in tension at a position 64 of the lever 62, but can move back freely relative to the lever 62. A spring 65, working in compression, is arranged between the latch 44 and a stop 66 fixed to the chassis 1. When the pedal 35 descends, the ramp 35*c* pushes away the latch 44, which is then pressed by the spring 65 into a groove 35*d* in the pedal 35**.

The latch 44 could, of course, lock the point **35*b* as represented in FIG. 12**.

I claim:

1. A roller skate comprising a chassis (1) consisting of at least one part equipped with rollers (2, 3, 4, 5) and a boot (6) fixed releasably to this chassis by fastening means which secure the boot to the chassis, at a first location (A) by hooking effected by the mutual longitudinal engagement of a part of the boot (9) and a part of the chassis (7), and at a second location (B) by a toggle-effect fastening device, wherein the toggle-effect fastening device is located in the chassis under the boot and comprises a latch (11; 23; 35) which is articulated to the chassis about a transverse pin and has a pointed end (**11*a*; 23*a*; 35*a***) that interacts with a housing on the boot, this latch being capable of occupying two stable positions, namely an obliquely raised position in which its point is out of the housing on the boot, and a lowered position in which its point is engaged in the housing on the boot, in the opposite direction to the engagement at the first hooking location, and kept engaged by the blocking of the toggle joint by exerting, a vertical pressure and a longitudinal thrust in the opposite direction.

2. The skate as claimed in claim 1, wherein the latch (11) is furthermore articulated to the end of a pair of toggle-articulated bars (14, 16).

3. The skate as claimed in claim 2, which comprises a lever (19) linked in rotation with one of the bars of the toggle joint for actuating the toggle joint in order to bring it into a blocking position.

4. The skate as claimed in claim 1, wherein the latch is in the form of a pedal (23; 35) which is lowered by pressure of the boot.

5. The skate as claimed in claim 4, wherein the pedal (23) is articulated to the end of a pair of toggle-articulated bars (26, 27) and it comprises a lever (28) linked in rotation with the toggle joint for actuating the toggle joint in order to bring it into a blocking position.

6. The skate as claimed in claim 4, wherein the pedal (35) has a second point (**35*b*), located under the first point (35*a*) and forming an acute angle with this first point, and it constitutes one of the arms of the toggle joint, the other arm (38**) being elastically compressible axially so that the toggle effect is obtained automatically when the pedal is lowered.

7. The skate as claimed in claim 6, which comprises auxiliary means (44; 58) for locking the pedal.

8. The skate as claimed in claim 7, wherein the auxiliary locking means consist of a latch (44) which slides in the chassis and locks the second point (**35*b***) of the pedal.

9. The skate as claimed in claim 7, wherein the locking means consist of a sliding latch (44) mounted at the end of an auxiliary toggle joint (53, **55*a***).

10. The skate as claimed in claim 7, wherein the locking means consist of a latch (58) which slides on the chassis and engages under the articulation (43) of the toggle joint.

11. The skate as claimed in claim 8, wherein the sliding latch (44) engages between the points (35*a*, 35*b*) of the pedal, and it is secured to a manually actuable lever (62).

12. The skate as claimed in claim 11, wherein the lower side of the second point (35*b*) of the pedal has a ramp which can push away the sliding latch (44) when the pedal descends, and the sliding latch is pushed in the direction of the pedal by a spring, so that locking is obtained automatically when the pedal is lowered.

13. The skate as claimed in claim 1, characterized in that the hooking at the first location (A) has at least one ramp which presses the boot against the skate.

14. The skate as claimed in claim 1, wherein the two fastening locations are in the heel region, and the skate and the boot have longitudinal guide means (31, 32) in front of the heel.

15. The skate as claimed in claim 1, wherein, at at least one of the two securing locations, the fastening means have means (10; 25; 41) for centering the boot on the skate.

* * * * *